US006574887B2

(12) United States Patent
Jones et al.

(10) Patent No.: US 6,574,887 B2
(45) **Date of Patent: *Jun. 10, 2003**

(54) FOOTWEAR WITH REVERSIBLE TONGUE

(75) Inventors: Lindell B. Jones, Wildwood, MO (US); Raymond F. Tonkel, Sudbury, MA (US)

(73) Assignee: U-Turn Sports Co, LLC, Westerfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/122,995

(22) Filed: Apr. 11, 2002

(65) Prior Publication Data

US 2002/0152637 A1 Oct. 24, 2002

Related U.S. Application Data

(60) Provisional application No. 60/285,693, filed on Apr. 24, 2001.

(51) Int. Cl.[7] ..... A43B 23/26; A43B 3/24; A43B 5/00; A43B 23/00; A43B 3/12

(52) U.S. Cl. ..... 36/54; 36/50.1; 36/136; 36/100

(58) Field of Search ..... 36/99, 100, 101, 36/114, 115, 116, 117.1, 118.2, 128, 126, 132, 136, 9 R, 54; 32/50.1

(56) References Cited

U.S. PATENT DOCUMENTS

| | | | | |
|---|---|---|---|---|
| 1,844,997 A | | 2/1932 | Weigle | |
| 4,372,060 A | | 2/1983 | Adamik | |
| 4,534,122 A | * | 8/1985 | MacPhail | 36/54 |
| 4,630,383 A | * | 12/1986 | Gamm | 36/136 |
| 4,805,321 A | | 2/1989 | Tonkel | |
| 5,379,529 A | | 1/1995 | Smith et al. | |
| 5,459,947 A | | 10/1995 | Lasher | |
| 5,659,979 A | | 8/1997 | Sileo | |
| 5,673,499 A | | 10/1997 | Attilieni | |
| 6,212,797 B1 | | 4/2001 | Merry et al. | |
| 6,321,466 B1 | | 11/2001 | Bordin et al. | |
| 6,397,497 B1 | | 6/2002 | McAtee | |
| 2002/0029494 A1 | | 3/2002 | Small | |

* cited by examiner

*Primary Examiner*—Anthony D. Stashick
(74) *Attorney, Agent, or Firm*—Paul M. Denk

(57) ABSTRACT

Footwear, incorporating a reversible a tongue, wherein one side or the other of the tongue may be adhered for pivot to the upper central vamp portion of the shoe, to display that side during wearing of the shoe, or turned, to provide a variation in the styling of the shoe. The tongue may further contain a pouch or pocket, secured by any type of fastening device such as Velcro that allows ready access into the tongue, for deposit or removal of personal items. One or more of the surfaces of the formed pocket, in the tongue, may be formed of a transparent or clear material, to allow any personal item deposited therein to be readily viewed.

10 Claims, 4 Drawing Sheets

FOOTWEAR WITH REVERSIBLE TONGUE

This Application claims the benefit of Prov. No. 60/285,693 filed Apr. 24, 2001.

BACKGROUND OF THE INVENTION

This invention relates generally to footwear, and more specifically pertains to a running, athletic, walking shoe or footwear in general, wherein the tongue or gusset is reversible, and may or may not contain an integral pocket, to provide a shoe which furnishes differing styles, and utilitarian usage, to the benefit of its wearer.

Obviously, numerous styles of footwear, constructed of various components, for achieving a multitude of purposes, have long been considered in the prior art. Most of these types of innovations have been in the area of running or athletic shoes, which has been substantially in vogue for the past three decades, wherein various styles of modifications to the soles, to make them more resilient, or add to the efficiency of the consumer, and various types of modifications to the structure of the shoe itself, such as even adding pockets to the side or within the tongue or gusset of the shoe, have been considered in the prior art. For example, see the patent to Adamik, U.S. Pat. No. 4,372,060, relating to this type of technology, and their modifications.

The current invention seeks further modifications to the structure of footwear, in order to add to the variations on usage of the shoe, enhance it's styling, and enhance the attractiveness of the footwear, by providing alternative uses and applications to various components of the footwear itself.

SUMMARY OF THE INVENTION

This invention contemplates the formation of footwear in general, including the running or athletic shoe type, but the concepts of this invention may be embodied within any type of shoe, as will be readily determined upon reviewing this invention. The footwear includes, but not limited to, the usual style of shoe having a sole, vamp, quarter portions, counter, and a tongue or gusset secured therein. In the preferred embodiment, the gusset will be of a reversible type, where the tongue can be turned to expose one surface, which may have a stylized and attractive surface provided thereon, or the tongue may be reversed, to furnish an entirely different appearance to the shoe, when worn.

This invention can pertain to an athletic shoe, casual and dress shoes, hikers or boots Means are provided to accommodate the reversing of the tongue, and to hold it to the upper vamp portion of the shoe, but which can be readily turned, simply upon opening of its fastening feature, or clasp, which normally holds the tongue in position, while the shoe is being worn. In addition, the tongue or gusset may, but not necessarily, include an internal pocket, that may be readily available for opening, preferably along the upper edge of the tongue, and into which personal items, such as a key or coin may be inserted. The tongue will contain closure means, to provide for its secure retention when closed, so as to prevent the loss of such personal items, and assure their safety. The tongue may further be fabricated, on one surface, with a transparent covering, at least approximate its upper edge, and overlying the formed pocket, so that even the contents of the pouch or pocket may be observable, if this is the desire of the wearer.

The concept of this invention is to provide a link between the shoe gusset or tongue, and the upper vamp portion of the shoe, so that the wearer may reverse the tongue, as desired, for revealing other coloration, indicia, or design. It provides versatility to the usage of the shoe. Such a linkage means could comprise a short link of cord, it may be an elastic cord, or perhaps could comprise a swivel clasp, or any type of other form of clasp, having some degree of flexibility, and which may be twisted or turned. In addition, it may include a clasp, formed of two parts that may swivel, and be interconnected between the upper vamp, and the bottom of the shoe gusset, to accommodate such turning motion. Furthermore, the clasp may be separable, through the exertion of some amount of force, so that the gusset may be removed, and another one relocated, to add further dexterity and versatility to the usage of this invention. In order to prevent the unauthorized removal, or the displacement of the gussets, for the shoes, as for example, when displayed for sale, the pulling force required to separate the clasp may be excessive, up to seventy to eighty pounds or more of pressure, or it may only require a slight amount of force, to separate the clasp, at the desire of the manufacturer, the retailer, and even the user, once the shoes are placed in usage. It is also likely that the tongue may be a compound, or more, style of tongue, having a swivel means between each of the sections of the tongue or gusset, to allow for turning, of just segments, of the tongue, along its heighth.

It is, therefore, a primary object of this invention to provide a reversible tongue for footwear.

Another object of this invention is to provide a reversible tongue that may have different styles of appearance upon either of its surfaces, so that the tongue can be reversed, and completely change the appearance and attractiveness of the shoe, to the interest of the footwear owner. For example, the consumer can coordinate with team colors, fashion trends, and the like.

Another object of this invention is to provide a pocket for the gusset of footwear so that personal items may be safely stored therein.

Still another object of this invention is to provide means for securing personal items of the wearer of the shoe, so that safety can be assured even while using the shoe for athletic events, or for running, but prevent the untimely loss of contained items, such as a key or coin, while participating in strenuous activities.

Yet another object of this invention is to provide a transparent covering for a pocketed tongue, for footwear, so that the contained items may be observed therein, while the shoe is worn.

Still another object of this invention is to provide a novel clasp that can be used for applying the reversible tongue to the upper central portion of the shoe vamp, to stably hold the tongue in place, while the shoe is being worn.

These and other objects may become more apparent to those skilled in the art upon reviewing the summary of this invention and upon undertaking a study of the description of its preferred embodiment, in view of the drawings.

BRIEF DESCRIPTION OF THE DRAWINGS

Referring to the drawings.

DESCRIPTION OF THE PREFERRED EMBODIMENT

Figure 1:
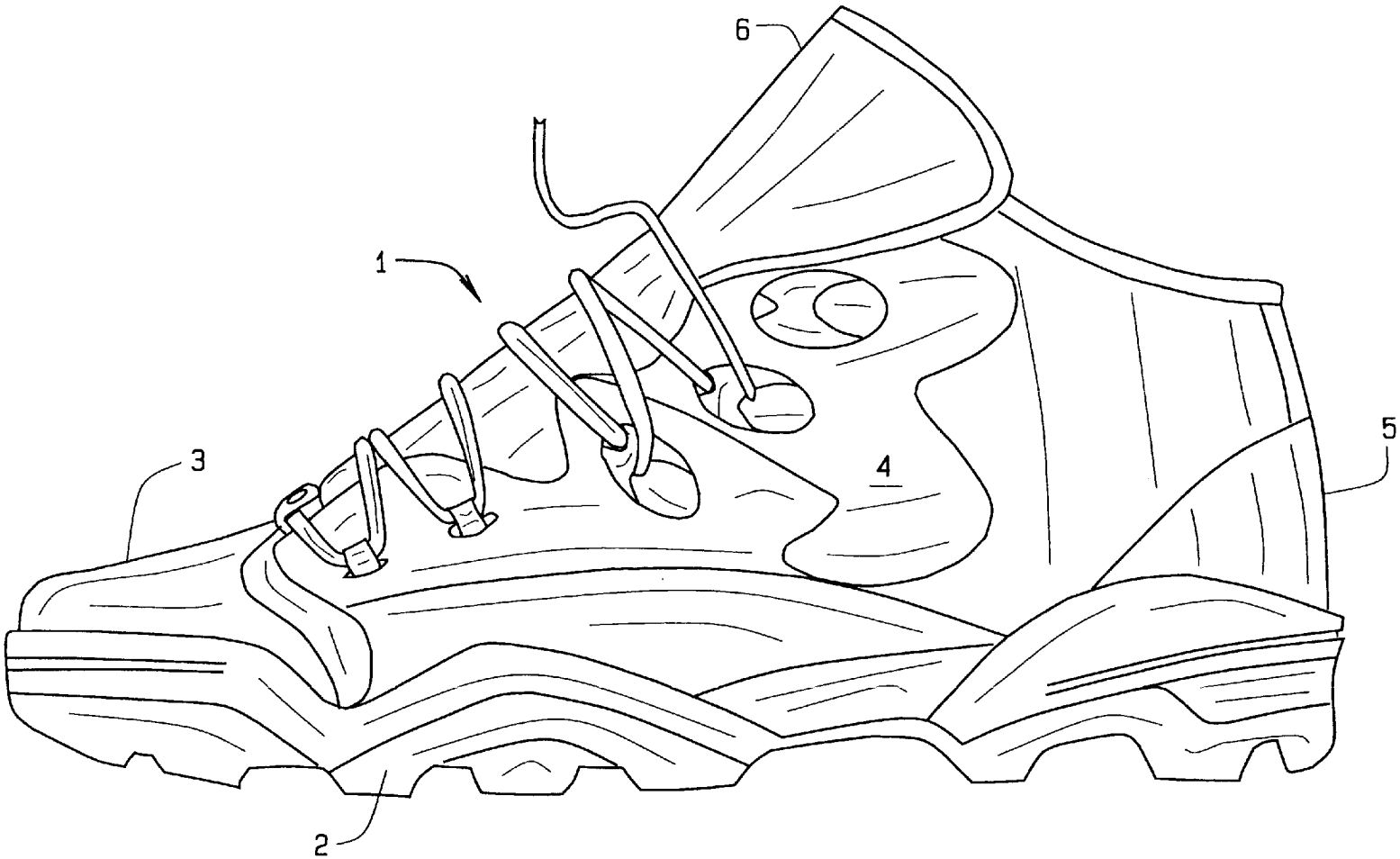
FIG. 1 is a side view of a shoe, such as a running shoe, containing the reversible tongue of this invention.
Figure 2:
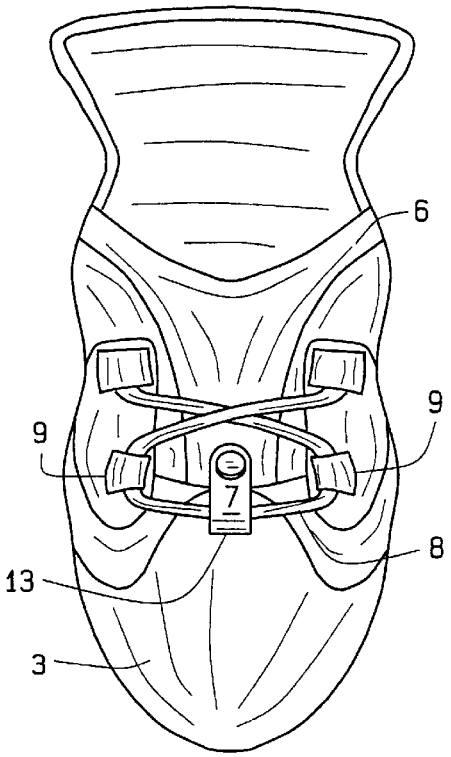
FIG. 2 is a top view of the partial shoe, showing the upper vamp, reversible tongue, clasp holding the tongue to the footwear, and cooperating with lacing to secure the shoe upon the foot of it's wearer.

In referring to the drawings, in particular FIG. 1, a shoe 1 is shown incorporating the usual components including the sole 2, its vamp 3, the quarter portions 4, and a counter 5. Also, as can be noted, the reversible tongue 6 is also disclosed. As can be seen in FIG. 2, the reversible tongue 6 is applied by means of a clasp 7 to the upper central portion of vamp 3, and cooperates to hold the tongue 6 in place, whichever side of the reversible tongue is desired to be exposed upwardly, when the footwear is worn. In addition, the clasp, when holding the tongue in place, cooperates to embrace the lower strand 8 of the shoe string, which further then extends through the various eyelets 9, for lacing the shoe in place upon the foot, as is well known. Obviously, it is not absolutely necessary in this invention to have the string 8 go through the clasp 7, and it need not necessarily do so, for the reversible tongue to be held in position upon the upper edge of the shown vamp.

Figure 3:
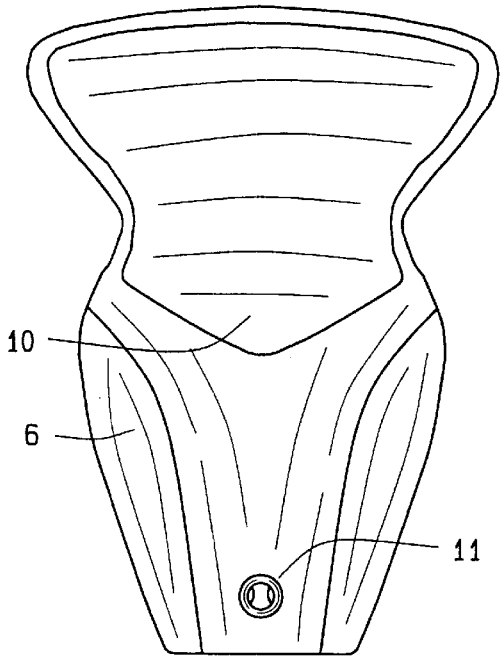
FIG. 3 is a top plan view of the reversible tongue of this invention.
Figure 4:
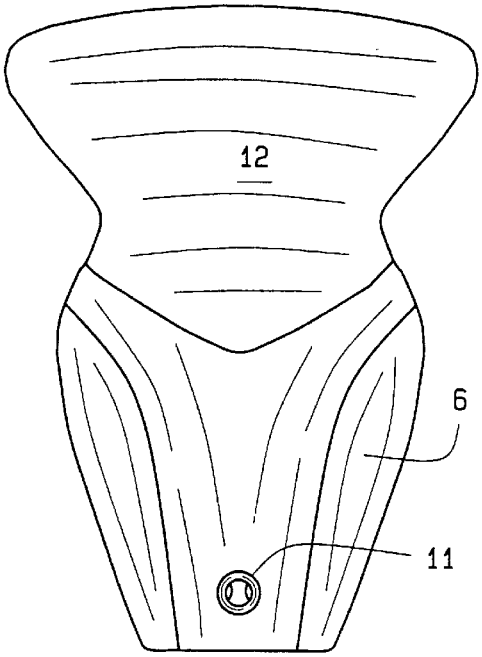
FIG. 4 is a top plan view of the opposite surface of the reversible tongue.

The tongue is reversible, and may contain some indicia, coloration, or a trademark, upon its top surface, as can been seen at 10, as noted in FIG. 3. The snap 11 that cooperates with the clasp, for holding the reversible tongue in position, is shown at the lower segment of the reversible tongue 6. In addition, the opposite side of the reversible tongue 6 can be seen in FIG. 4, and it may contain other indicia, or styling, along its surface, as may be desired by the footwear designer, or the shoe owner, as may be of interest. This can be applied to the upper portion 12 of the reversible tongue, or along its entire upper surface, as noted.

Obviously, while the preferred embodiment shows means for clasping through snaps the reversible tongue to the upper center portion of the shoe vamp, as noted in FIG. 2, it is just as likely that instead of using a clasp 7, the reversible tongue may snap directly to the upper edge of the vamp, having a snap upon both lower surfaces of the reversible tongue, so that it can be snapped directly to the vamp, regardless which surface of the reversible tongue is desired to be arranged upwardly, simply through the efforts of the footwear owner, by releasing the tongue, reversing it, and snapping it back into a fixed position, relative to the shoe vamp.

Or, the tongue might be held by other means of connection, such as through the use of a tie means, the Velcro strip, or any other means for securement, for firmly holding the tongue in place, for use in displaying whatever surface of the tongue is desired to be shown.

Figure 5:
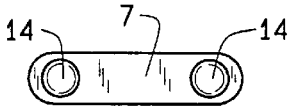
FIG. 5 is a view of the opened clasp.
Figure 6:
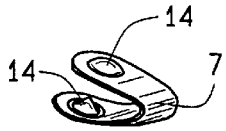
FIG. 6 shows the clasp in the process of being snapped into closure.

FIGS. 5 and 6 show one example of a type of clasp 7 that may be employed. The clasp comprises a length of flexible material, and may even be resilient, and inserts through a slot 13 provided in the upper central portion of the vamp 3, as noted. The clasp may then be folded over, and connect with the male part of the snap, that is secured approximate to the lower edges, on both sides, of the tongue 6, as can be seen at 11, and which snap into the female components of the snaps, as shown at 14, as can be seen.

Figure 7:
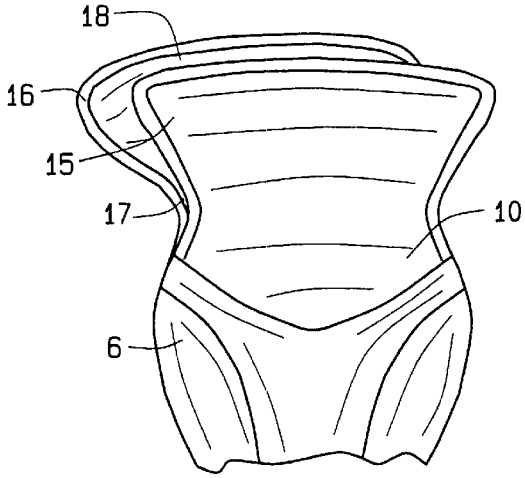
FIG. 7 shows the reversible tongue containing a pocket in its upper half, and which may be secured by Velcro, or the like, into closure.

Another feature of this invention is to furnish the reversible tongue 6 with a pocket or pouch. This can be seen in FIG. 7. The upper segment, or the entire pocket, may be formed of a pair of liners of material, such as can be seen at 15 and 16, have a spacing there between, stitched around the edges up to the proximate point of the pocket's opening, as at 17. Then, means for securing the upper peripheral edges of the pocket may be provided, such as through the use of the hook and pile fastener means 18, or Velcro, that is affixed to the upper interior edges of both of the liners 15 and 16, to furnish closure to the formed pocket.

As previously reviewed, one upper surface of the tongue 6 may include some indicia, or styling, as noted at 10, may include the display of the trademark, or other stylization, as can be noted. The opposite side, or lower side 12 of the pocket, may also be somewhat reinforced, as seen, but it may be fabricated to a different style or it may be formed, at that region, of a transparent or clear material, so that the contents of the pocket are readily observed when the tongue may be fastened to the footwear with the layer 12 comprising the upper surface of the reversible tongue, reversed in a manner as previously described. This may add to the enhanced attractiveness of the footwear, having a reversible tongue with a transparent pocket provided therein, for use for holding personal items, or the wearer may decide to put a photograph under the transparent liner, so as to allow it to be readily observable, while the shoes are worn, by the owner.

Figure 8:
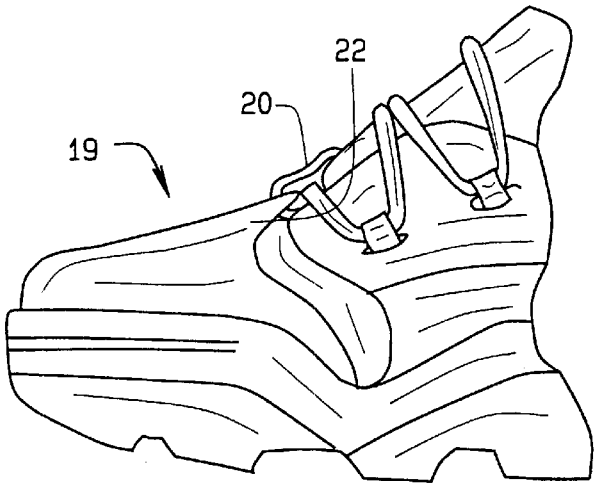
FIG. 8 is a side view of a modified more casual shoe having a different style of means for connecting the reversible tongue to the shoe vamp.
Figure 9:
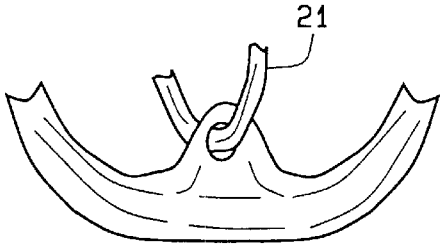
FIG. 9 shows an elastic type of clasp, which is in the form of an elastic band, that can insert through the top of the vamp, and either temporarily or permanently connect with the reversible tongue.
Figure 10:
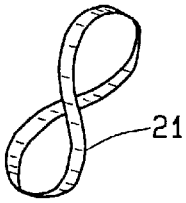
FIG. 10 shows how the elastic band may be reversed, into a figure eight configuration, for reversing its permanently held gusset or tongue in place.

FIGS. 8 through 10 disclose another method for holding the reversible tongue in place, in this particular instance, upon a more casual type of footwear. As noted, the footwear 19 in FIG. 8, at its upper vamp portion, has an aperture 20 located therethrough. Through this aperture 20 there is located a type of clasping means, in this particular instance, a band, which may be made of a more elastomeric, resilient, or elastic material, as noted at 21. Preferably, the band, as shown in FIG. 10, may be continuous, as noted.

Thus, where it has some resiliency, or is elastic in texture, it may easily be reversed, by twisting, as noted, so that the tongue or gusset can be easily reversed, as previously described in this application, to attain the attributes of the reversing feature of this invention. Furthermore, the tongue will be permanently adhered to the vamp, so that the tongues cannot be shoplifted, or inadvertently removed, as for example, when displayed in the store, which might be done with the snap type of connection, as previously explained. Hence, this method of attachment adds more permanency to the structure of the reversible tongue when used in combination with the shown shoe. Furthermore, the upper part of the vamp, as at 22, may be slightly elevated, to extend off of the instep of a foot, so that whatever bulk is generated through the reversing of the band, in holding the tongue in place, will not bind against the foot, and add discomfort thereat. These are examples as to how the reversible tongue may be used in combination with footwear, of any style, to provide the attributes as explained herein. Where the aperture 20 is provided there may be a grommet furnished, to prevent any tearing of the vamp at that location, and to provide longevity of usage of the shoe, and its reversible tongue, by the owner.

Figure 11:
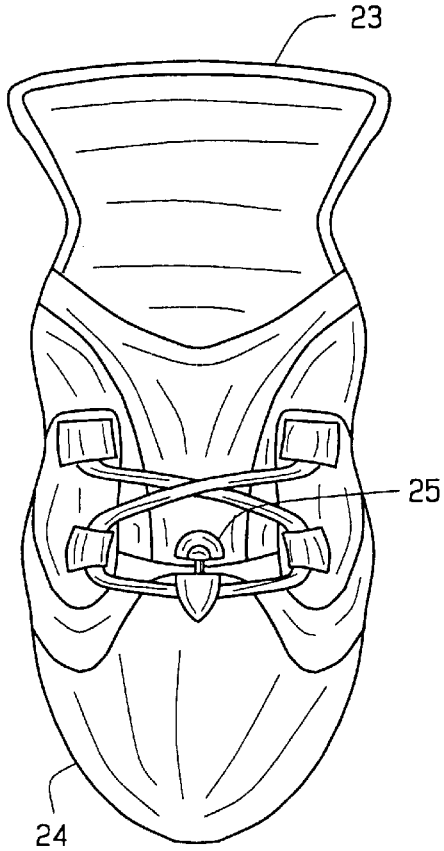
FIG. 11 is a top view of a partial shoe, showing the upper vamp, reversible tongue, ball and socket attachment holding the tongue to the footwear, and cooperating with lacing to secure the shoe upon the foot of its wearer.

As can be seen in FIG. 11, the reversible tongue 23, is attached to the vamp 24 applied by means of the ball and socket attachment 25.

Figure 12:
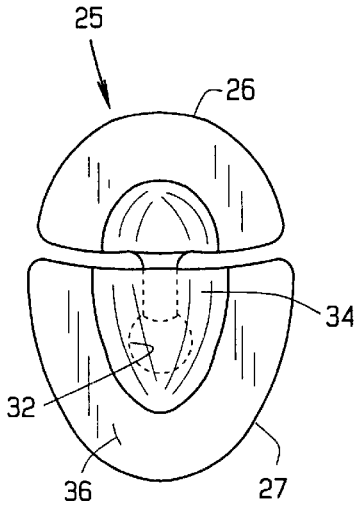
FIG. 12 is a top plan view of the ball and socket attachment according to the preferred embodiment.
Figure 13:
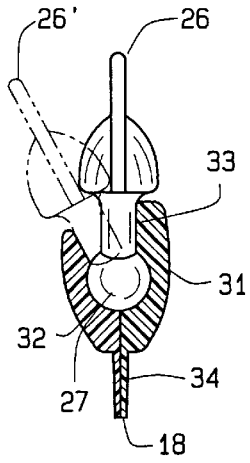
FIG. 13 is a side partially sectional view of the ball and socket attachment according to the preferred embodiment.

In referring to FIGS. 12 and 13, the ball and socket attachment 25 comprises a ball portion 26, and a socket portion 27 attached to the vamp 24, as previously shown. The ball portion 26 is preferably both movable between a position shown by said ball portion, and a position shown by the ball portion 26' in phantom, and rotatable within the socket portion 27, as can be understood.

As a result, the tongue 23 is fully rotatable about an axis A, as noted, and restricted rotation or pivot about the axis B perpendicular to the plane of FIG. 13, as through an angle C, and therefore orients the gusset generally in its upright position, but frees it sufficiently forwardly, to pivot or rotate, as desired by the user. The axis B can be described as roughly perpendicular to the axis A.

The ball portion 26 is preferably made from a resilient polymeric material. In addition, as previously explained, it may be desired to provide a basis for separation of the ball portion, from within the socket, when the user desires to change gussets, and that force can be either minimal, or perhaps even at a high strength, so that during shipment, storage, or display upon the market, the gussets cannot be too easily removed, by unauthorized persons, until such time as the pair of shoes are sold.

Figure 14:
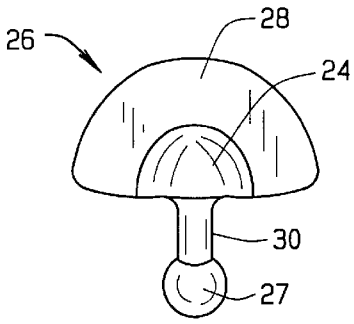
FIG. 14 is a front view of a ball portion according to the preferred embodiment.
Figure 15:
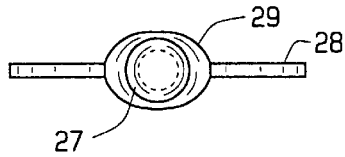
FIG. 15 is a bottom view of a ball portion according to the preferred embodiment.
Figure 16:
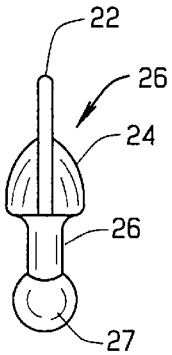
FIG. 16 is a right side view of socket ball portion according to the preferred embodiment.

In referring to FIG. 14, the ball portion 26 comprises the ball 27, as shown, a flat attachment portion 28 and a rounded attachment portion 29, as noted. The rounded attachment portion 29 is attached to the ball 27 by a generally cylindrical neck portion 30. The tongue 23 may be either a singular or laminar piece of material, made from a fabric, a polymer, or leather, or the like. The flat attachment portion 28 is attached to the tongue by an adhesive, by sewing, or otherwise attaching the flat attachment portion 28 to the tongue 23, by any means known in the art. If the tongue 23 is a laminar piece, that flat attachment portion 28 of the ball portion 26 is preferably attached to the tongue between the laminar layers to minimize visibility. The preferred method of attachment differs depending upon the material of the tongue 23.

Referring back to FIGS. 12 and 13, the socket portion 27 preferably comprises a socket 31. The top portion of the socket is defined by a cavity 32 at the bottom of the slot 33 for accepting the ball 27, as can be noted. The bottom portion 27, of the socket, includes flat attachment extensions 34 that are used to attach the top and bottom portions, of the entire clasp, or swivel, to the vamp 24 of the shoe. Similar to the tongue or gusset 23, the vamp may be either a singular or laminar piece of material made from a fabric, a polymer, or leather, or the like. The portions 34 and 28 may be attached to the vamp 24 in a similar manner as the ball portion 26 is attached to the tongue or gusset 23, as explained.

The upper portion 31 of the socket, in defining its bore 32, has some element of flexibility, that allows the ball portion 26, and more specifically its ball 27, to be moved into or out of the socket, as can be understood.

In addition, since the upper portion 31 of the socket portion has that angular opened relationship, as shown by the angle C, the ball portion 26 can be moved into the various positions, forwardly of the shoe, to allow the reversible tongue to be pivoted slightly forwardly, to facilitate is reversal when manipulated in the manner as described herein. In addition, the diameter of the bore may be selected such that the ball 27 may be forcibly removed from its socket 27, by resiliently deflecting the top part 31 or 35 of the socket, as can be noted. Alternatively, it can be provided that the ball 27 is not removable from the bore 32. In this instance, it can be seen that the socket 27 may be formed of two halves, one comprising the top part 35, and the back part 36, which may be adhesively or otherwise secured together, to form a permanent socket 27, as noted. Thus, to provide for a permanent mount of the ball 27 within the socket bore 32, the ball 27 must be placed within the socket 32 before the top and bottom parts 35 and 36 are attached to one another. Or, as previously explained, there may be some slight resiliency in the upper part 35, to allow the ball 27 to be forcibly removed from the socket, when it is desired to separate the tongue or gusset from the shoe, as noted. In either instance, it is preferred that the ball 27, and hence the tongue 23, have sufficient clearance to allow for the tongue to be rotatable by means of its ball 27 within the socket bore 32, in order to expose a second side of the tongue 23, as can be understood. In this manner, the tongue 23 may have first and second sides, of differing color, material, designs, and/or displaying indicia, and may be alternatively displayed by the user by mere rotation of the tongue 12, in the spirit of this invention.

It is further just as likely that the ball and socket connection could be replaced with a bayonet style of locking device. Or, one of those bead style of ball and socket connectors, such as currently available for use in the construction of a necklace, bracelet, or the like, could be adapted for use for swively connecting the tongue or gusset to the vamp portion of the footwear.

Figure 17:
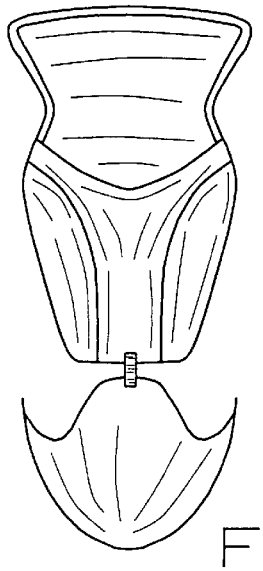
FIG. 17 is a top view of the partial shoe, showing the upper vamp, reversible tongue, and a link holding the tongue or gusset to the footwear, for providing the reversible feature.

The concept of this invention may be generally paraphrased by reviewing FIG. 17. Essentially, the essence of the invention is to provide some linking means, as at 37, that holds the tongue 38 to the upper portion 39 of the shoe vamp 40. Hence, that linking means may be any one of the swivels, and elastic cord, a flexible rubber or polymer, or an elastic means, that allows the tongue to be reversed in its setting. And, as previously explained, the concept of the invention is to also provide, when a swivel is used, one that may possibly be separable, so that the tongue can actually be removed, and replaced with a substitute gusset, for adding further design and coloration to the footwear, when worn.

Obviously, the reversible tongue can be formed of a variety of materials, whether it be a fabric, polymer, leather, transparent acrylic or polyethylene, any as such materials which add to the attractiveness of the shoe, but at the same time, provide reasonable strength and sturdiness to withstand the constant and repeat usage.

Variations or modifications to the subject matter of this invention may occur to those skilled in the art upon reviewing the disclosure as provided herein. For example, while it has been described that the tongue may be both removable and rotatable, it would be within the present invention if only one of these functions were provided. Furthermore, it should be relatively clear that the concept of this invention could be used for almost any style of footwear, even adapted into a sandal, or other shoe variation, as can be understood. Such variations are believed to be within the spirit of this invention, and are intended to be encompassed within the scope of any claims to invention as provided herein. The description of the preferred embodiment as set forth herein is done so for illustrative purposes only.

It is claimed:

1. A device for attaching a shoe to a tongue comprising a ball and socket attachment comprising a ball portion attached to the tongue and a socket portion attached to the shoe wherein the ball is rotatably secured within the socket such the tongue may be rotated about a first axis without deformation while still attached to the shoe to alternatively expose a first and second side of the tongue.

2. The device of claim 1 wherein the shoe further comprises a vamp and the socket portion is attached to the vamp.

3. The device of claim 1 wherein the device allows rotation of the tongue through a limited angle about an axis generally perpendicular to the first axis of rotation.

4. The device of claim 1 wherein the tongue includes one or more pockets.

5. A device for attaching a shoe to a tongue comprising a ball and socket attachment comprising a ball portion comprising a ball attached to one of the shoe and tongue, and a socket portion defining a socket attached to the other of the shoe and tongue, wherein the ball is rotatably secured within the socket such that the tongue may be rotated about a first axis without deformation while still attached to the shoe to alternatively expose a first and second side of the tongue.

6. The device of claim 5 wherein the shoe further comprises a vamp and the ball portion is attached to the vamp.

7. The device of claim 5 wherein the device allows rotation of the tongue through a limited angle about an axis generally perpendicular to the first axis of rotation.

8. The device of claim 1 wherein the tongue includes one or more pockets.

9. The device of claim 5 wherein the socket includes front and back portions, said front and back portions being adhered together to capture the ball portion during assembly of the ball and socket device.

10. The device of claim 9 wherein said ball is separable from the socket, the force required to separate the ball from the socket being in the range of twenty to eighty pounds 20 to 80 lbs.

* * * * *